United States Patent [19]

Maksymiak et al.

[11] 3,942,888

[45] Mar. 9, 1976

[54] STEPPED TRANSFER ROLLER

[75] Inventors: John Maksymiak, Penfield; Daniel S. Hoffman, Rochester, both of N.Y.

[73] Assignee: Xerox Corporation, Stamford, Conn.

[22] Filed: Feb. 6, 1975

[21] Appl. No.: 547,412

[52] U.S. Cl. ..... 355/3 R; 96/1.4

[51] Int. Cl.[2] ..... G03G 15/16

[58] Field of Search ..... 355/3 TR; 96/1.4; 118/621; 427/25, 24

[56] References Cited

UNITED STATES PATENTS 2,807,233 9/1957 Fitch ..... 96/1.4 X 3,627,523 12/1971 Shelffo ..... 96/1.4

*Primary Examiner*—Robert P. Greiner

[57] ABSTRACT

A biased roller electrostatographic image transfer system in which the diameter of a resilient bias transfer roll is slightly larger at its outer end areas in comparison to its central copy sheet engaging area, so that the majority of the roll loading pressure is absorbed by these larger diameter end steps, which roll directly against the imaging surface outside of the copy area, and so that a relatively lower roll pressure is provided against the copy sheet in the operating nip. This reduction in the mechanical pressure in the transfer nip can provide lower "hollow character" transfer defects, yet allows a sufficiently high roller loading force to prevent roll bounce and vibration.

11 Claims, 3 Drawing Figures

FIG. 1
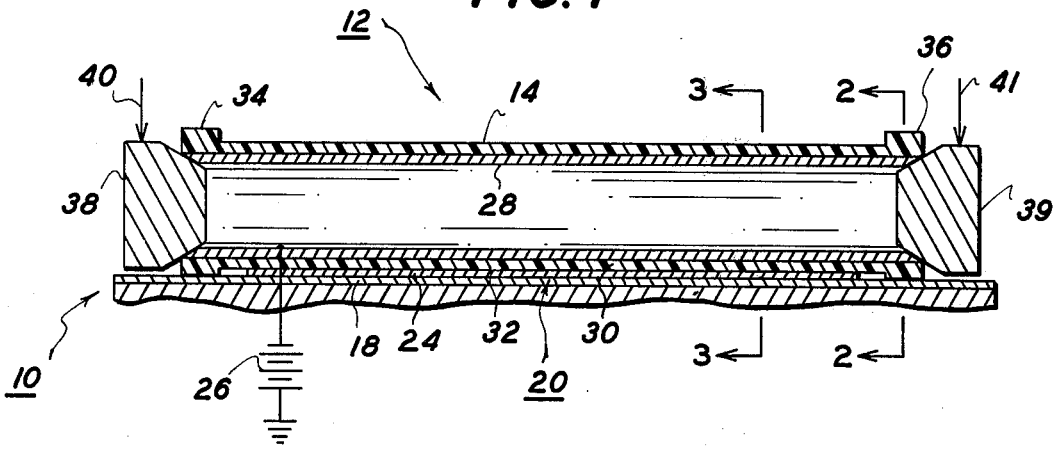
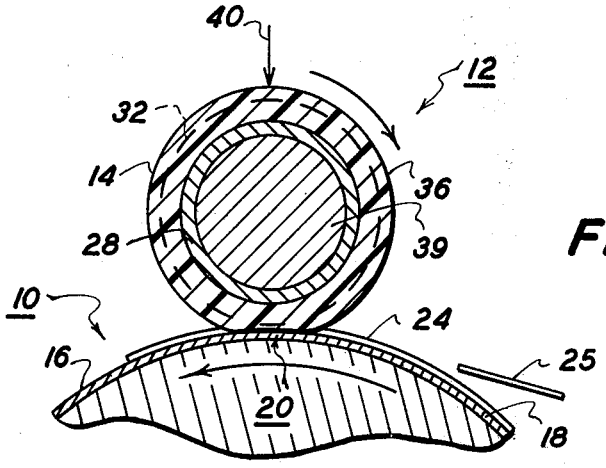
FIG. 2
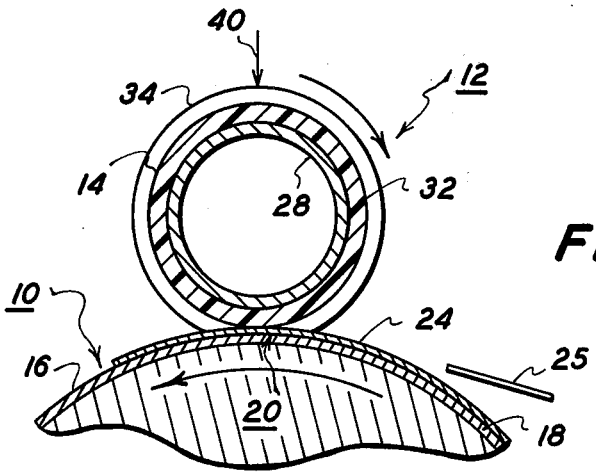
FIG. 3

STEPPED TRANSFER ROLLER

The present invention relates to a biased roller image transfer system in electrostatography in which the transfer roller has slight differences in its diameter to control transfer nip pressure.

In a conventional transfer station in electrostatography, toner (image developer material) is transferred from the photoreceptor (the original support and imaging surface) to the copy sheet (the final support surface or transfer member). The toner is then fixed to the copy sheet, typically in a subsequent thermal fusing station.

In xerography, this transfer is most commonly achieved by electrostatic force fields created by D.C. charges applied to or adjacent the back of the copy sheet while the front side of the copy sheet contacts the toner-bearing photoreceptor surface. The transfer field must be sufficient to overcome the forces holding the toner onto the photoreceptor and to attract the toner over onto the copy sheet. These transfer fields are generally provided in one of two ways: by ion emission from a transfer corotron onto the copy paper, or by a D.C. biased transfer roller or belt rolling along the back of the paper, and holding it against the photoreceptor.

The present invention relates to bias roller transfer systems. Some examples are described in U.S. Pat. Nos. 2,807,233; 3,043,684; 3,267,840; 3,328,193; 3,598,580; 3,625,146; 3,630,591; 3,684,364; 3,691,993; 3,702,482; 3,781,105; 3,832,055; and 3,847,478. The present invention is particularly suitable as an improvement in any system in which the nip pressure is critical or sensitive, such as systems in which the roller is constructed of a resilient semi-conductive or electrically relaxable material, as described in the above-cited U.S. Pat. Nos. 3,781,105 and 3,702,482.

The difficulties of successful electrostatographic image transfer are well know. In the pre-transfer (pre-nip) region or area, before the copy paper contacts the image, if the transfer fields are high the toner image is susceptible to premature transfer across too great an air gap, leading to decreased image resolution and, in general, to fuzzy images. Further, if there is pre-nip ionization, it may lead to strobing defects, loss of transfer efficiency, or "splotchy" transfer and a lower latitude of acceptable system operation. In the post-nip region, at the photoconductor-paper separation area, if the transfer fields are too low (e.g., less than approximately 12 volts per micron for lines and 6 volts per micron for solid areas) hollow characters may be generated, especially with smooth papers, high toner pile heights and high nip pressures (greater than approximately 0.07 kg per square cm). If the fields in certain portions of the post-nip region are otherwise improper, the resulting ionization may cause image instability and paper detaching. On the other hand, in the nip region itself, to achieve high transfer efficiency and avoid retransfer, the transfer field should be as great as possible (greater than approximately 20 volts per micron). To achieve these desired different and non-symmetrical fields in these adjacent regions consistently and with appropriate transitions is difficult, especially where the air gaps are defined by the symmetrical geometry of a cylindrical roller.

The transfer or nip pressure (mechanical force per unit area of engagement) can be a critical factor in many bias roller transfer systems. One of the problems is the mechanical pressure generated at the roll nip contributing to a copy defect called hollow characters. It has been observed that a lower roll pressure results in lower hollow characters. However, the amount that the roll loading force (and resulting pressure) of a conventional roller can be decreased is limited by mechanical design considerations of roll bounce and vibration, i.e., too low a roll mechanical biasing force can cause other serious copy defects.

The transfer system of the invention is intended to overcome many of the above-discussed problems with a very simple and inexpensive transfer roller structure. It may be utilized for transfer with an imaging surface of any desired configuration, such as a cylinder or a belt. It may also be used for transfer to an intermediate surface rather than a final copy surface, and for duplex as well as simplex transfer systems. Copy and copy sheets as referred to herein will be understood to include uncut webs, etc.

The present disclosed system provides stepping of the outside diameter of the transfer roll such that a majority of the roll loading force (and pressure) can be absorbed by slightly larger diameter steps located outside of the copy sheet area, so that much lower pressures are obtained in the transfer nip. This can provide reduced hollow character defects yet also provide a high roll loading force.

The above-cited and other references teach details of various suitable exemplary xerographic or other electrostatographic structures, materials, systems and functions known to those skilled in the art, and thus are incorporated by reference in this specification, where appropriate.

Further objects, features and advantages of the present invention pertain to the particular apparatus and details whereby the above-mentioned aspects of the invention are attained. Accordingly, the invention will be better understood by reference to the following description of one example thereof, and to the drawings forming a part of this description, which are substantially to scale except that the differences in diameter of the roller steps and the copy sheet thickness are exaggerated for clarity, wherein:

FIG. 1 is a central cross-sectional view of an exemplary biased roller transfer system in accordance with the present invention;

FIG. 2 is a cross-sectional view taken along the line 2—2 of FIG. 1; and FIG. 3 is a cross-sectional view taken along the line 3—3 of FIG. 1.

Referring to FIGS. 1–2, there is shown therein the transfer station of an exemplary and otherwise conventional electrostatographic copying system 10 having a cylindrical transfer roller member 12 which is an example of the present invention. The cylindrical outer surface 14 of the transfer member 12 is urged towards the imaging surface 16 of a conventional photoreceptor 18 to define a transfer nip 20. Toner particles are transferred from the imaging surface 16 to the facing surface of a copy sheet 24 as it is passed through the transfer nip 20. The copy sheet 24 is held against the imaging surface 16 by the transfer member 12 and the transfer is effected by electrical transfer fields generated between the transfer member 12 and the imaging surface 16. These transfer fields are generated by applying an electrical bias from a bias voltage source 26 to a conductive core 28 of the transfer member 12, and by providing a grounded substrate for the photoreceptor 18. It will be appreciated that an image-wise pattern of the toner is formed on the imaging surface 16 by suitable conventional electrostatographic processes prior to its entry into the transfer station.

The exemplary bias transfer roller 12 here comprises a cylindrical metal tube or the like providing a conductive core 28, which is covered here with a homogeneous and substantially uniform layer 30 of resilient material providing the exterior surface 14 of the roller. This material layer 30 is preferably electrically semi-conductive or relaxable as described in the above-cited U.S. Pat. Nos. 3,781,105 and 3,702,482 or disclosed in the transfer roller of the Xerox "9200" high speed commercial xerographic duplicator.

This substantially cylindrical and resiliently deformable integral exterior surface 14 of the roller 12 here has a central portion 32 and two integral end portions 34 and 36 at each end of the central portion 32. The central portion 32 has a constant first diameter and extends in length along the roller 12 axis by a distance which is greater than the predetermined maximum lateral dimension of any copy sheet 24 to be utilized for copying herein. It will be appreciated that this maximum lateral dimension of the copy sheet will depend on whether the copy sheets are being fed long edge first or short edge first (sideways or endwise) through the transfer nip 20.

The end portions 34 and 36 have an equal second diameter which is slightly greater than the first diameter of the central portion 32. That is, the end portions 34 and 36 are cylindrical steps slightly extended uniformly radially outwardly from the central portion 32. The end portions 34 and 36 are entirely outside of, and spaced from, the nip area 20 in which the transfer is being effected to the copy sheet 24 from the imaging surface 16. Thus, the end steps 34 and 36 are directly in contact with, and rollably ride against, the imaging surface 16. At no time is any portion of the copy sheet 24 interposed between either of the end portions 34 or 36 and the imaging surface 16, in contrast to the central portion 32. A pre-nip sheet lead-in baffle 25 provides engagement of the sheet 25 with the imaging surface 16 prior to its passage into the nip 20 under the central portion 32.

Considering now the mechanical loading of the transfer roller 12 against the imaging surface 16, this may be accomplished in various conventional mechanical embodiments. For clarity, this is illustrated here two conventional conical end bearings 38 and 39 providing a rotatable bearing connection with the interior of the metal core 28 of the roller 12. Arrows 40 and 41, respectively, are shown to indicate force vectors providing a thrust through these end bearings 38 and 39 to the roller 12 in the direction of the imaging surface 16. This force may be provided by springs, weights, solenoids or any other suitable or conventional force generating system. It provides a pre-set total force 40–41 pressing the transfer roller 12 against the surface 16 of the imaging support member, the photoreceptor 18. This roller loading force must, of course, be sustained or resisted by the pressures of the roller 14 against the photoreceptor times the areas of contact.

Referring now particularly to the differences which may be seen between the two different cross-sections of FIG. 2 and FIG. 3 transverse the axis of roller 12, it may be seen that the pressure and deformation of the end portions 34 and 36 is much greater than that of the central portion 32 of the roller. The radii of the end portions 34 and 36 are much more highly deformed, i.e., their radii in the area of engagement with the surface 16 are much more greatly reduced with respect with their normal uncompressed radii than is the central portion 32. Due to the relatively greater deformation of the end areas 34 and 36, their area of contact with the imaging surface 16 is greater per unit length of the roller 12. The step height or uncompressed radial extention above the central portion 32 of the end portions 34 and 36 and their axial length and the resistance to deformation of their selected material is such that the pressure of the end areas 34 and 36 against the imaging surface 16 is much greater than the pressure of the central portion 32 against the copy sheet 24.

This higher pressure in the area of engagement of the end portions 34 and 36 provides a total engagement force or supporting force for the roller 12 which is more than one-half of the total loading force 40–41 applied to the roller 12. Thus, more than one-half of the force which otherwise would be applied almost entirely to the copy sheet 24 by the central portion 32 is carried by the end portions 34 and 36 instead. To achieve this, the end portions 34 and 36 have an uncompressed step height or radius extension above the central portion 32 which is greater than the maximum thickness of the copy sheet 24 in the nip 20. However, this step height cannot be significantly more than the maximum paper thickness, e.g., approximately 0.06 cm., in order to prevent the central portion 32 from ever coming out of contact with or providing less than a minimum desired pressure with, the copy sheet 24. The copy sheet 24 must be pressed uniformly against the imaging surface 16 at all times in the nip by the central portion 32 to achieve reliable transfer. The axial length or width of the end portions 34 and 36 is preferably only a minor portion of the axial length of the central portion 32 to facilitate greater deformation for a suitable total loading force. For example, an axial length of between 1 and 3 centimeters could be selected for each end portion, depending on the material of the roller layer 30. It will also be appreciated that the roller layer 30 could be an integral composite of different materials providing the desired properties, although that is not desired here.

The above-described structure provides the desired result of a transfer nip force which is substantially less than the total force by which the roller is biased against the imaging surface. The transfer roller loading force can be amply high and effectively independent of the nip force, in contrast to a conventional cylindrical roller in which an increase in roller loading force is directly applied to the transfer nip.

Although not essential, the roller 12 and its applied loading force can be preset so that with no copy sheet in the nip 20 the central portion 32 of the roller surface is spaced slightly out of contact with the imaging surface 16 by a uniform distance which is slightly less than the minimum thickness of the copy sheet 24. With this arrangement, the roller loading force can be easily adjusted by inserting conventional feeler gauge or shim stock of the desired thickness in the nip 20. Uniformity of loading from end to end of the roller can be readily tested and adjusted in this manner.

As noted, for effective transfer the central portion 32 must provide a minimum pressure transfer nip with the copy sheet 24, pressing it against the imaging surface 16. The exterior surface 14 of the roller cannot be out of contact with the sheet 24 in the nip 20 and provide reliable transfer. Thus, in operation, the minimum compressed radius of the end portions 34 and 36 at the center of their contact area with the imaging surface 16 here is always greater than the minimum compressed radius of the central portion 32 in the nip 20 only by the thickness of the copy sheet 24 in the nip 20. The resilience of the roller layer 30 allows this relationship to be maintained for different copy sheet thicknesses within the predetermined thickness range of copy sheets for which the system is adapted.

In conclusion, there has been described herein a novel transfer system for electrostatographic copying providing improved bias roller transfer characteristics with a simple structural arrangement. Numerous modifications and variations thereof will be obvious to those skilled in the art. The following claims are intended to cover all such variations and modifications as fall within the true spirit and scope of the invention.

What is claimed is:

1. In an electrostatographic copying system wherein an image is transferable from image support surface means to copy sheets of a predetermined range of thickness and a predetermined maximum lateral dimension, wherein a transfer roller forms a transfer nip with said image support means for passage of said copy sheets through said nip against said image support means for said image transfer, and wherein pressure means are provided for pressing said transfer roller against said image support means with a preset total force, the improvement wherein:

said transfer roller has a substantially cylindrical and resiliently deformable integral exterior surface with a central portion and two integral end portions at each end of said central portion, said central portion has a first diameter and extends in length along said roller further than said predetermined maximum lateral dimension of said copy sheets, said end portions have a second diameter slightly greater than said first diameter of said central portion, said end portions directly deformably rollably engage said image support means with a force from said pressure means which is a substantial portion of said total force, and said force on said end portions producing a first pressure, and said central portion rollably engages said copy sheets in said nip with a second pressure which is substantially lower than said first pressure.

2. The copy system of claim 1, wherein said force of both said end portions against said image support means is more than one-half of said total force applied by said pressure means to said transfer roller.

3. The copying system of claim 1, wherein said central portion is substantially less deformed in said nip than said end portions are deformed against said image support means.

4. The copying system of claim 1, wherein said roller has a homogenious layer of resilient material providing said integral exterior surface.

5. The copying system of claim 4, wherein said layer of resilient material is electrically relaxable and electrically biased for said image transfer.

6. The copying system of claim 2, wherein said central portion is substantially less deformed in said nip than said end portions are deformed against said image support means.

7. The copying system of claim 4, wherein said central portion is substantially less deformed in said nip than said end portions are deformed against said image support means.

8. The copying system of claim 1, wherein said central portion presses against said copy sheets in said nip with a nip force which is substantially less than said total force applied by said pressure means.

9. The copying system of claim 8, wherein said nip force is less than one-half, and wherein said force of both said end portions against said image support means is more than one-half, of said total force applied by said pressure means to said transfer roller.

10. The copying system of claim 1, wherein said end portions are cylindrical steps from said central portion.

11. The copying system of claim 1, wherein said end portions are adapted to hold said central portion spaced from said image support means by a distance less than said predetermined range of thicknesses of said copy sheets.

* * * * *